US006471290B1

(12) United States Patent
Moody et al.

(10) Patent No.: US 6,471,290 B1
(45) Date of Patent: Oct. 29, 2002

(54) DETACHABLE STORAGE DEVICE FOR A DESK

(76) Inventors: Mary E. Moody, P.O. Box 114, Camden, AL (US) 36726; Malicia A. Moody, P.O. Box 114, Camden, AL (US) 36726

( * ) Notice: Subject to any disclaimer, the term of this patent is extended or adjusted under 35 U.S.C. 154(b) by 0 days.

(21) Appl. No.: 09/849,424

(22) Filed: May 4, 2001

(51) Int. Cl.[7] ..... A47C 7/62
(52) U.S. Cl. ..... 297/188.2; 297/217.1
(58) Field of Search ..... 297/188.2, 188.01, 297/188.18, 217.1; 108/50.11, 26; 206/216; D19/73; 30/451, 453, 454, 456–459, 452

(56) References Cited

U.S. PATENT DOCUMENTS

| | | | | |
|---|---|---|---|---|
| 174,777 | A | * | 3/1876 | Buzby |
| 480,547 | A | * | 8/1892 | Battelle |
| 763,878 | A | | 6/1904 | Gilson et al. |
| 929,461 | A | | 7/1909 | Munn |
| 2,184,173 | A | | 12/1939 | Bargen |
| 2,807,371 | A | | 9/1957 | Johnson |
| 4,050,491 | A | | 9/1977 | Hargrove |
| D342,094 | S | * | 12/1993 | Ancona et al. |
| D359,404 | S | | 6/1995 | Svee |
| 5,720,226 | A | * | 2/1998 | Padovano |
| 5,887,940 | A | * | 3/1999 | Anderson et al. |
| 6,021,891 | A | * | 2/2000 | Anderson |
| 6,283,042 | B1 | * | 9/2001 | Wargo et al. |

* cited by examiner

*Primary Examiner*—Milton Nelson, Jr.

(57) ABSTRACT

A detachable storage device for a desk for providing a storage area for a desk. The detachable storage device for a desk includes a first container having a bottom wall and a peripheral wall extending upwardly from and being integrally coupled to the bottom wall. A securing assembly removeably secures the first container to a desk. A second container has a bottom wall and a peripheral wall extending upwardly from the second container. The peripheral wall of the second container is attached to the securing assembly. A pencil sharpener is attached to an upper edge of the second container. A third container having a bottom wall and a perimeter wall extending upwardly from the bottom wall. The perimeter wall having a height generally equal to a height of the peripheral wall of said first container.

4 Claims, 2 Drawing Sheets

DETACHABLE STORAGE DEVICE FOR A DESK

BACKGROUND OF THE INVENTION

1. Field of the Invention

The present invention relates to storage devices and more particularly pertains to a new detachable storage device for a desk for providing a storage area for a desk.

2. Description of the Prior Art

The use of storage devices is known in the prior art. More specifically, storage devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,050,491; U.S. Pat. No. 763,878; U.S. Pat. No. 2,184,173; U.S. Pat. No. 929,461; U.S. Pat. No. 2,807,371; U.S. Des. Pat. No. 359, 404.

While these devices fulfill their respective, particular objectives and requirements, the aforementioned patents do not disclose a new detachable storage device for a desk. The inventive device includes a first container having a bottom wall and a peripheral wall extending upwardly from and being integrally coupled to the bottom wall. A securing means for removably secures the first container to a desk. A second container has a bottom wall and a peripheral wall extending upwardly from the second container. The peripheral wall of the second container is attached to the securing means. A pencil sharpener is attached to an upper edge of the second container.

In these respects, the detachable storage device for a desk according to the present invention substantially departs from the conventional concepts and designs of the prior art, and in so doing provides an apparatus primarily developed for the purpose of providing a storage area for a desk.

SUMMARY OF THE INVENTION

In view of the foregoing disadvantages inherent in the known types of storage devices now present in the prior art, the present invention provides a new detachable storage device for a desk construction wherein the same can be utilized for providing a storage area for a desk.

The general purpose of the present invention, which will be described subsequently in greater detail, is to provide a new detachable storage device for a desk apparatus and method which has many of the advantages of the storage devices mentioned heretofore and many novel features that result in a new detachable storage device for a desk which is not anticipated, rendered obvious, suggested, or even implied by any of the prior art storage devices, either alone or in any combination thereof.

To attain this, the present invention generally comprises a first container having a bottom wall and a peripheral wall extending upwardly from and being integrally coupled to the bottom wall. A securing means for removably secures the first container to a desk. A second container has a bottom wall and a peripheral wall extending upwardly from the second container. The peripheral wall of the second container is attached to the securing means. A pencil sharpener is attached to an upper edge of the second container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new detachable storage device for a desk apparatus and method which has many of the advantages of the storage devices mentioned heretofore and many novel features that result in a new detachable storage device for a desk which is not anticipated, rendered obvious, suggested, or even implied by any of the prior art storage devices, either alone or in any combination thereof.

It is another object of the present invention to provide a new detachable storage device for a desk which may be easily and efficiently manufactured and marketed.

It is a further object of the present invention to provide a new detachable storage device for a desk which is of a durable and reliable construction.

An even further object of the present invention is to provide a new detachable storage device for a desk which is susceptible of a low cost of manufacture with regard to both materials and labor, and which accordingly is then susceptible of low prices of sale to the consuming public, thereby making such detachable storage device for a desk economically available to the buying public.

Still yet another object of the present invention is to provide a new detachable storage device for a desk which provides in the apparatuses and methods of the prior art some of the advantages thereof, while simultaneously overcoming some of the disadvantages normally associated therewith.

Still another object of the present invention is to provide a new detachable storage device for a desk for providing a storage area for a desk.

Yet another object of the present invention is to provide a new detachable storage device for a desk which includes a first container having a bottom wall and a peripheral wall extending upwardly from and being integrally coupled to the bottom wall. A securing means for removably secures the first container to a desk. A second container has a bottom wall and a peripheral wall extending upwardly from the second container. The peripheral wall of the second container is attached to the securing means. A pencil sharpener is attached to an upper edge of the second container.

Still yet another object of the present invention is to provide a new detachable storage device for a desk that is removably attachable to desks requiring additional storage area.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
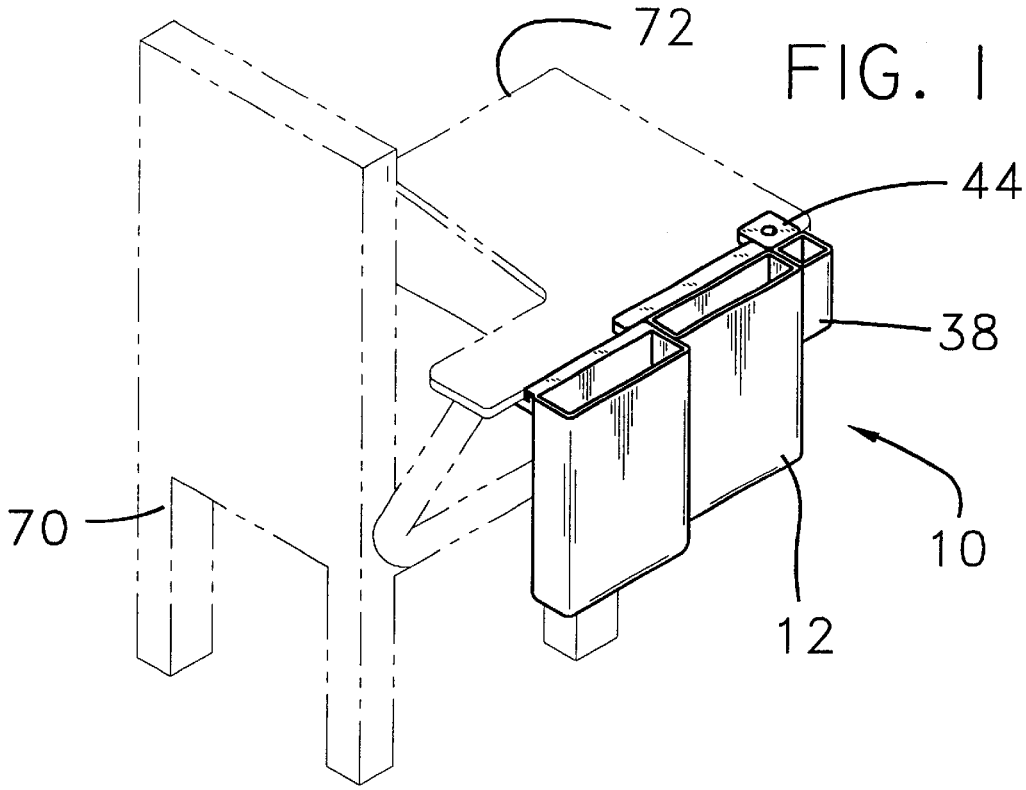
FIG. 1 is a schematic perspective view of a new detachable storage device for a desk according to the present invention.
Figure 3:
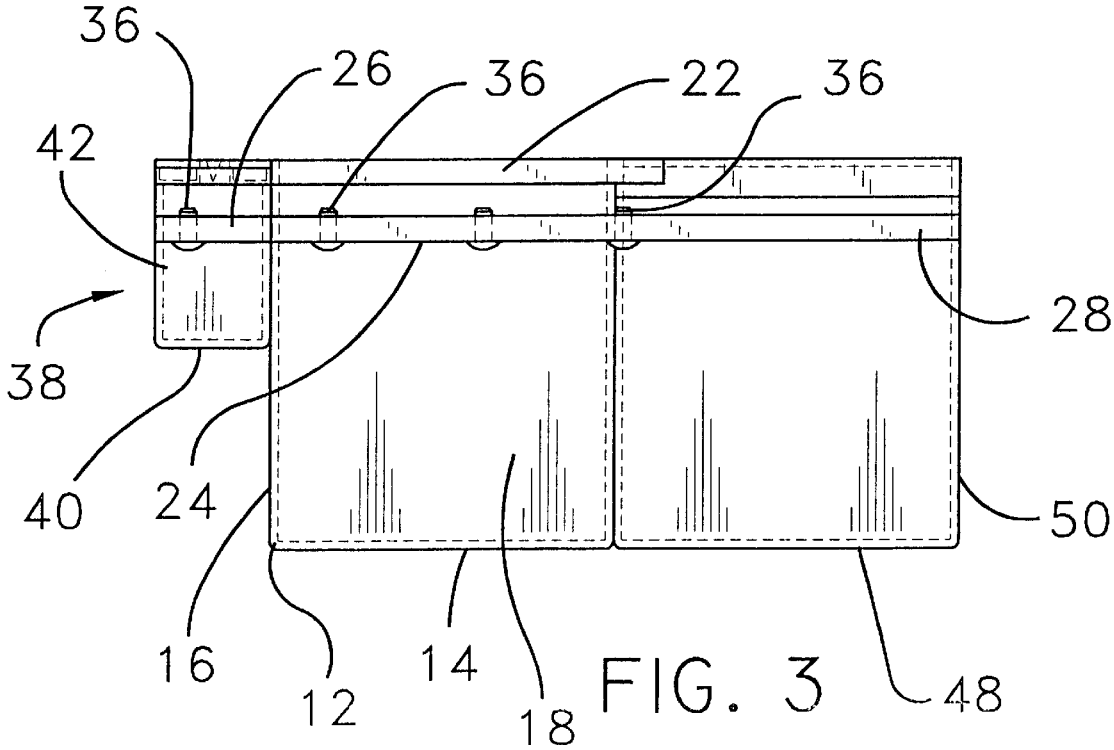
FIG. 3 is a schematic back view of the present invention.
Figure 2:
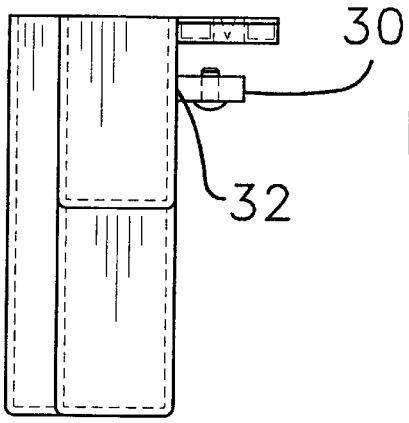
FIG. 2 is a schematic side view of the present invention.
Figure 4:
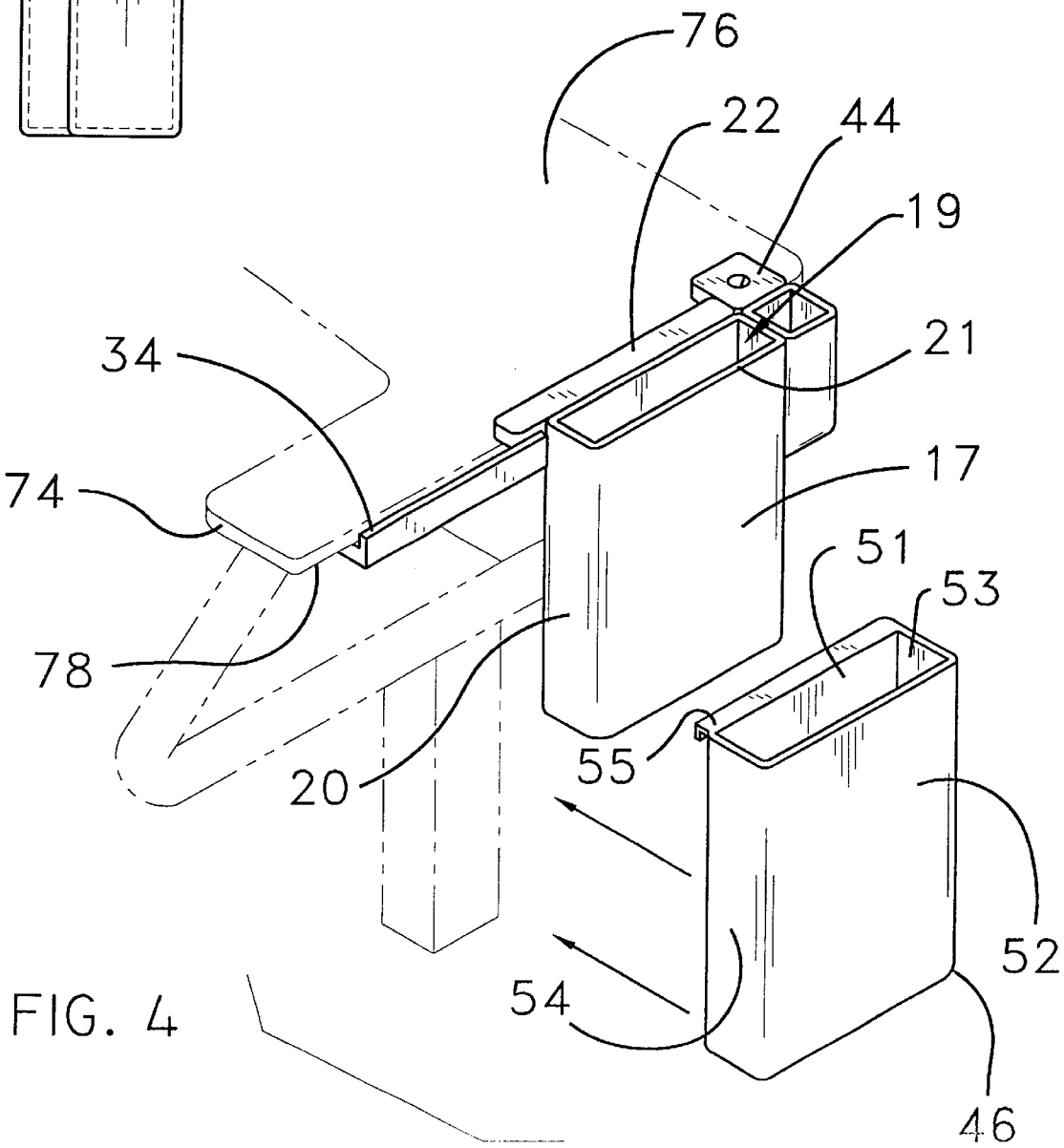
FIG. 4 is a schematic perspective view of the present invention.

With reference now to the drawings, and in particular to FIGS. 1 through 4 thereof, a new detachable storage device for a desk embodying the principles and concepts of the present invention and generally designated by the reference numeral 10 will be described.

As best illustrated in FIGS. 1 through 4, the detachable storage device for a desk 10 generally comprises a storage device which is abuttable against a peripheral edge 74 of a table portion 72 of a conventional school desk 70. The table portion 72 has a top surface 76 and bottom surface 78.

The device 10 includes a first container 12 having a bottom wall 14 and a peripheral wall 16 extending upwardly from and integrally coupled to the bottom wall 14. The peripheral wall 16 includes a front wall 17, a back wall 18, a first lateral side wall 19 and a second lateral side wall 20. The peripheral wall 16 has a top edge 21. The peripheral wall 16 has a height generally between 10 inches and 14 inches. The front 17 and back 18 walls have a length generally between 8 inches and 10 inches. The side walls 19, 20 have a length generally between 1 inch and 3 inches.

A securing means removably secures the first container 12 to the table portion 72. The securing means includes comprises a lip 22 attached to the top edge 21 of the back wall 18 and extending outwardly away from the peripheral wall 16 at a generally perpendicular orientation to the back wall 18.

A plate 24 is attached to the back wall 18 and extends between the lateral side walls 19, 20. The plate 24 is orientated generally perpendicular to the back wall 18 and is spaced from the lip 22 a distance generally between 1 inch and 3 inches. The plate 24 has a first outer portion 26 extending past the first lateral side wall 19 and a second outer portion 28 extending past the second lateral side wall 20. The second outer portion 28 has an inside edge 30 and an outer edge 32. The outer edge 32 is adjacent to the first container 12 and has a flange 34 attached thereto. The flange 34 extends along a length of the second outer portion 28. The flange 34 extends upwardly.

Each of a plurality of fasteners 36 is extendable through the plate 24 and is abuttable against the bottom surface 78 of the table portion 72 when the table portion 72 is extended between the lip 22 and the plate 24. Each of the fasteners 36 preferably comprises a bolt.

A second container 38 has a bottom wall 40 and a peripheral wall 42 extending upwardly from the second container 38. The peripheral wall 42 of the second container 38 is attached to the first outer portion 26 of the plate 24. The peripheral wall 42 of the second container 38 has a height generally between 4 inches and 6 inches and a length and width generally equal to a length of the lateral side walls 19, 20 of the first container 12. The second container 38 defines a pencil holder.

A pencil sharpener 44 is attached to an upper edge of the second container 38 such that the pencil sharpener 44 is positioned over the top surface 76 of the table portion 72 when the first container 12 is secured to the table portion 72.

A third container 46 has a bottom wall 48.and a perimeter wall 50 extending upwardly from the bottom wall. The perimeter wall 50 includes a first wall 51, a second wall 52, a third wall 53 and a fourth wall 54. The perimeter wall 50 has a top edge. A rim 55 extends along a length of the top edge of the first wall 51. The rim 55 has a generally upside down L-shape taken traverse to a longitudinal axis of the rim 55. The rim 55 is positionable over the flange 34 such that the third container is removably secured to the plate 24. The perimeter wall 50 has a height generally equal to a height of the peripheral wall 16 of the first container 12. The third container 46 defines a trash container.

In use, the device 10 is used as a storage device removably attachable to a conventional school desk 70 which does not have its own storage means.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A storage device, said device being abuttable against a peripheral edge of a table portion of a school desk, the table portion having a top surface and bottom surface, said device comprising:

a first container having a bottom wall and a peripheral wall extending upwardly from and integrally coupled to said bottom wall, said peripheral wall including a front wall, a back wall, a first lateral side wall and a second lateral side wall, said peripheral wall having a top edge, said peripheral wall having a height generally between 10 inches and 14 inches, said front and back walls having a length generally between 8 inches and 10 inches, said side walls having a length generally between 1 inch and 3 inches;

a securing means for removably securing said first container to said table portion comprises;

a lip being attached to said top edge of said back wall and extending outwardly away from said peripheral wall at a generally perpendicular orientation to said back wall;

a plate being attached to said back wall and extending between said lateral side walls, said plate being orientated generally perpendicular to said back wall and being spaced from said lip a distance generally between 1 inch and 3 inches, said plate having a first outer portion extending past said first lateral side wall and a second outer portion extending past said second lateral side wall, said second outer portion having an inside edge and an outer edge, said outer edge being adjacent to said first container and having a flange attached thereto, said flange extending along a length of said second outer portion, said flange extending upwardly;

a plurality of fasteners being extendable through said plate and being abuttable against said bottom surface of said table portion when said table portion is extended between said lip and said plate, each of said fasteners comprising a bolt;

a second container having a bottom wall and a peripheral wall extending upwardly from said second container, said peripheral wall of said second container being attached to said first outer portion of said plate, said peripheral wall of said second container having a height generally between 4 inches and 6 inches and a length and width generally equal to a length of said lateral side walls of said first container;

a pencil sharpener being attached to an upper edge of said second container such that said pencil sharpener is positioned over said top surface of said table portion when said first container is secured to said table portion; and a third container having a bottom wall and a perimeter wall extending upwardly from said bottom wall, said perimeter wall including a first wall, a second wall, a third wall and a fourth wall, said perimeter wall having a top edge, a rim extending along a length of said top edge of said first wall, said rim having a generally upside down L-shape taken traverse to a longitudinal axis of said rim, said rim being positionable over said flange such that said third container is removably secured to said plate, said perimeter wall having a height generally equal to a height of said peripheral wall of said first container.

2. A storage device, said device being abuttable against a peripheral edge of a table portion of a school desk, the table portion having a top surface and bottom surface, said device comprising:

a first container having a bottom wall and a peripheral wall extending upwardly from and integrally coupled to said bottom wall;

a securing means for removably securing said first container to said table portion, said securing means being attached to said first container;

a second container having a bottom wall and a peripheral wall extending upwardly from said second container, said peripheral wall of said second container being attached to said securing means;

a pencil sharpener being attached to an upper edge of said second container such that said pencil sharpener is positioned over said top surface of said table portion when said first container is secured to said table portion;

said peripheral wall of said first container including a front wall, a back wall, a first lateral side wall and a second lateral side wall, said peripheral wall having a top edge;

said securing means comprises;

a lip being attached to said top edge of said back wall and extending outwardly away from said peripheral wall at a generally perpendicular orientation to said back wall;

a plate being attached to said back wall and extending between said lateral side walls, said plate being orientated generally perpendicular to said back wall and being spaced from said lip a distance generally between 1 inch and 3 inches, said plate having a first outer portion extending past said first lateral side wall and being attached to said peripheral wall of said second container; and a plurality of fasteners being extendable through said plate and being abuttable against said bottom surface of said table portion when said table portion is extended between said lip and said plate.

3. The storage device as in claim 2, wherein said device further includes:

a second outer portion extending past said second lateral side wall, said second outer portion having an inside edge and an outer edge, said outer edge being adjacent to said first container and having a flange attached thereto, said flange extending along a length of said second outer portion, said flange extending upwardly;

a third container having a bottom wall and a perimeter wall extending upwardly from said bottom wall, said perimeter wall having a top edge having a rim attached thereto, said rim having a generally upside down L-shape taken traverse to a longitudinal axis of said rim, said rim being positionable over said flange such that said third container is removably secured to said plate.

4. A storage device, said device being abuttable against a peripheral edge of a table portion of a school desk, the table portion having a top surface and bottom surface, said device comprising:

a first container having a bottom wall and a peripheral wall extending upwardly from and integrally coupled to said bottom wall;

a securing means for removably securing said first container to said table portion, said securing means being attached to said first container;

a second container having a bottom wall and a peripheral wall extending upwardly from said second container, said peripheral wall of said second container being attached to said securing means;

a pencil sharpener being attached to an upper edge of said second container such that said pencil sharpener is positioned over said top surface of said table portion when said first container is secured to said table portion;

a third container having a bottom wall and a perimeter wall extending upwardly from said bottom wall, said perimeter wall being removably attached to said securing means.

* * * * *